US006300861B1

(12) United States Patent
Osada et al.

(10) Patent No.: US 6,300,861 B1
(45) **Date of Patent: *Oct. 9, 2001**

(54) ORGANIC THERMISTOR DEVICE AND METHOD OF PRODUCING SAME

(75) Inventors: Shinichi Osada; Tomozo Yamanouchi; Yuichi Takaoka; Takashi Shikama, all of Shiga (JP)

(73) Assignee: Murata Manufacturing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/407,150

(22) Filed: Sep. 28, 1999

(30) Foreign Application Priority Data

Nov. 4, 1998 (JP) ..... 10-313781

(51) Int. Cl.[7] ..... H01C 7/10; H01C 7/13

(52) U.S. Cl. ..... 338/22 R; 338/22 SD; 338/208; 29/610.1

(58) Field of Search ..... 338/208, 22 R, 338/22 SD; 361/321, 58

(56) References Cited

U.S. PATENT DOCUMENTS 4,329,726 * 5/1982 Middleman et al. ..... 361/58
4,330,703 * 5/1982 Horsma et al. ..... 219/553
4,334,148 * 6/1982 Kampe ..... 219/553
5,227,946 * 7/1993 Jacobs et al. ..... 361/106

FOREIGN PATENT DOCUMENTS 40-5283207 * 10/1993 (JP) .
6-53008-A * 2/1994 (JP) .

* cited by examiner

*Primary Examiner*—Karl D. Easthom
*Assistant Examiner*—Kyung S. Lee
(74) *Attorney, Agent, or Firm*—Coudert Brothers

(57) ABSTRACT

An organic thermistor device has a pair of outer electrodes formed facing each other on end parts of a thermistor body made of an organic thermistor material. Metallic wires extend inside and through the thermistor body transversely to the direction in which the outer electrodes face each other such that the resistance value at normal temperatures of the device can be significantly reduced. Both exposed surfaces of the thermistor body not covered by the outer electrodes and exposed end surfaces of the metallic wires not covered by the thermistor body may be all covered by an electrically insulating layer. To produce such organic thermistor devices, an elongated wire-containing member is prepared by molding an organic thermistor material by covering metallic wires extending longitudinally parallel to one another. It is then entirely covered with an electrically insulating material but portions of it are removed from a pair of longitudinally continuous external peripheral surface areas. Outer electrodes are thereafter formed on this pair of surface areas and the wire-containing member is then cut transversely to the direction of its elongation at specified positions to divide into individual elements. The newly exposed surfaces of these individual elements by cutting may be covered by an electrically insulating material.

16 Claims, 4 Drawing Sheets

ORGANIC THERMISTOR DEVICE AND METHOD OF PRODUCING SAME

BACKGROUND OF THE INVENTION

This invention relates to a surface-mountable thermistor device which may be used for protection against an overcurrent. More particularly, this invention relates to an organic thermistor device comprising a thermistor element made of an organic thermistor material, as well as a method of producing such organic thermistor devices.

Organic PTC (positive temperature coefficient) thermistors made of an organic thermistor material are coming to be used as circuit protection units for suppressing overcurrents. Such organic PTC thermistor devices make use of an organic thermistor material obtained by dispersing carbon or the like in a resin material such as polyethylene to provide a positive temperature characteristic (PTC characteristic). They are generally produced, as shown in FIG. 6, by forming surface electrodes 52*a* and 52*b* by pressing a metallic foil of nickel or copper on both upper and lower surfaces of a thermistor body 51 of an organic thermistor material shaped in a planar form and then forming outer electrodes 53*a* and 53*b* by plating or sputtering. Alternatively, an organic thermistor device may be formed, as shown in FIG. 7, by using an electrically insulating material 54 such as an insulating resin to cover exposed parts such as the thermistor body 51 and the surface electrodes 52*a* and 52*b*, leaving only the outer electrodes 53*a* and 53*b* exposed.

An organic thermistor device, as described above, may be surface-mounted, as shown in FIG. 8, by electrically and mechanically connecting the outer electrodes 53*a* and 53*b* to wiring electrodes (or "lands") 56 on a printed circuit board 55 by a solder reflowing method through a solder fillet 57.

In the case of a PTC thermistor device for protecting a circuit from an overcurrent situation, its resistance value at normal temperatures is desired to be 0.1Ω or less such that a voltage drop in the PTC thermistor device during the use of the circuit can be avoided. If the specific resistance, the thickness and the cross-sectional area of the PTC thermistor body 51 are ρ, T and S, respectively, the resistance value of the PTC thermistor device is given by ρT/S.

If an organic PTC material is to be used for the PTC thermistor device, the fact at the present time is that it is difficult to make the specific resistance equal to or less than 0.5 Ωcm if this PTC thermistor material must also have the required electrical characteristics when its resistance value changes suddenly under a high-temperature condition. Accordingly, if it is attempted to use such an organic PTC thermistor material to produce an organic PTC thermistor device with resistance value equal to or less than 0.1Ω at normal temperatures, the result will be a structure as shown in FIG. 7 having surface electrodes 52*a* and 52*b* formed on both upper and lower surfaces of a planar thermistor body 51 made of an organic thermistor material by pressing a metallic foil of nickel or copper.

Even if a PTC thermistor device is produced in a form as shown in FIG. 7 with surface electrodes on both upper and lower surfaces of the thermistor body, the thickness of the thermistor body 51 must be made very small and its cross-sectional area large in order to make its resistance value at normal temperatures equal to or less than 0.1Ω. With prior art organic PTC thermistor devices, therefore, the dimensions of the thermistor body 51 were, for example, 4.5 mm (length)×3.2 mm (width)×0.3 mm (thickness).

Although it is an essential requirement for a PTC thermistor device to reduce the resistance value at normal temperatures, this requirement could be satisfied with the prior art technology only by reducing the thickness of the thermistor body and increasing its cross-sectional area (or its planar area). As a result, the planar dimensions of the product remained large and a large space was required for its surface-mounting. Secondly, a relatively large amount of organic thermistor material will be used for the production and this gives rise to an increased production cost. Thirdly, if the thermistor body is very thin, it is likely to become twisted or bent after being mounted. Fourthly, if a large amount of the organic thermistor material is used between the pair of outer electrodes, the action time of the PTC thermistor device becomes long and there may arise situations where a sufficient protective characteristic against overcurrents cannot be obtained and the circuit element to be protected may break before the PTC thermistor device can act.

An attempt may be made to introduce inner electrodes into the PTC thermistor body by stacking organic PTC sheets with an electrode formed thereon, but the layer-forming process including steps of making thinner organic PTC sheets, forming conductors to serve as inner electrodes and stacking up the sheets one on top of another tends to increase the production cost as a whole. Thus, the price of the product will increase significantly and hence such a method is not a practical solution to the problem.

SUMMARY OF THE INVENTION

It is therefore an object of this invention, in view of the problems described above, to provide a compact organic thermistor device which has a small resistance value at normal temperatures and is both reliable and economically advantageous.

Another object of this invention is to provide a method of producing such organic thermistor devices.

An organic thermistor device embodying this invention, with which the above and other objects can be accomplished, may be characterized as comprising a thermistor body made of an organic thermistor material, a pair of mutually facing outer electrodes formed on end parts of this thermistor body, and metallic wires extending inside and through the thermistor body transversely to the direction in which the outer electrodes face each other. With an organic thermistor device thus structured, the resistance value at normal temperatures can be significantly reduced. If metallic wires with specific resistance of about 1 Ωcm are buried inside an organic thermistor material, it is equivalent to reducing the distance between the pair of outer electrodes because the specific resistance of the metallic wires is negligible and is much smaller than that of the organic thermistor material. If both exposed surfaces of the thermistor body not covered by the outer electrodes and exposed end surfaces of the metallic wires not covered by the thermistor body are all covered by an electrically insulating layer, the reliability of the product is further improved because, when it is mounted to a circuit board, short-circuiting between the various components of the device and other electronic components and wires on the circuit board can be prevented. Where there are a plurality of wires passed through the organic thermistor body, it is preferred that they extend approximately parallel to one another because the volume ratio of the metallic wires inside the thermistor body can be kept high.

To produce organic thermistor devices of the invention as characterized above, an elongated wire-containing member is formed by molding an organic thermistor material by covering metallic wires so as to extend longitudinally through the thermistor body, and a pair of longitudinally elongated outer electrodes is formed on mutually opposite sides of the external peripheral surface of this wire-containing member. Such outer electrodes may be formed by entirely covering the wire-containing member as formed above with an electrically insulating material and then removing portions of it from a pair of longitudinally continuous external peripheral surface areas of the wire-containing member. The outer electrodes are thereafter formed on this pair of longitudinally continuous portions of the external peripheral surface of the wire-containing member from which the insulating material has been removed. The wire-containing member is then cut transversely to the direction of its elongation at specified positions to be divided into individual elements. The newly exposed surfaces of these individual elements by cutting may be covered by an electrically insulating material. By such a method characterized by first preparing such a wire-containing member and forming what is later going to be the outer electrodes before the elongated wire-containing member is cut into individual units, organic thermistor devices of this invention can be efficiently produced.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, like or equivalent components are indicated by the same symbols even where they are components of different organic thermistor devices and may not necessarily be described repetitiously for simplifying the disclosure.

DETAILED DESCRIPTION OF THE INVENTION

Figure 1A:
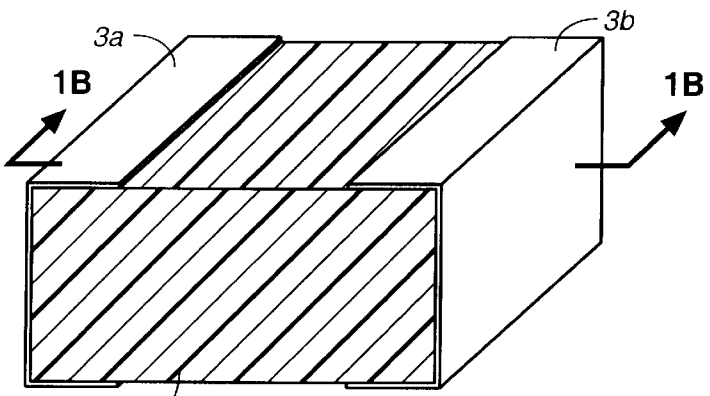
FIG. 1A is a diagonal external view of an organic thermistor device embodying this invention.
Figure 1B:
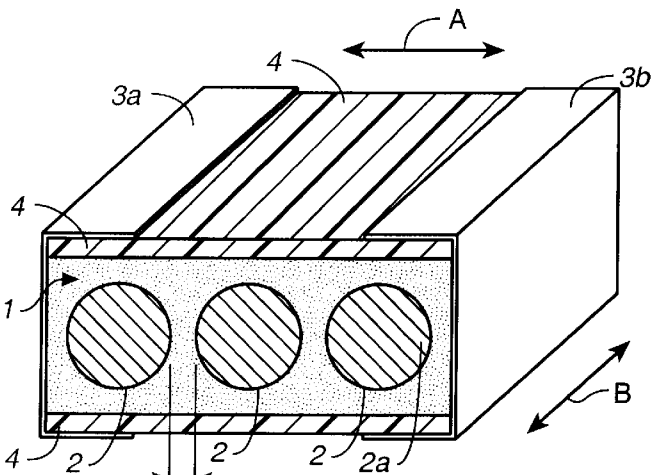
FIG. 1B is its sectional view taken along line 1B—1B of FIG. 1A.

FIGS. 1A and 1B are respectively an external view and a sectional view of an organic thermistor device embodying this invention. Outer electrodes 3*a* and 3*b* are formed as a pair on mutually opposite end parts (including a mutually oppositely facing surfaces) of a thermistor body 1 comprising an organic thermistor material obtained by dispersing carbon in a resin material such as polyethylene so as to provide a PTC characteristic. Penetrating through the interior of this thermistor body 1, electrically insulated from these outer electrodes 3*a* and 3*b*, are a plurality of mutually separated and disconnected metallic wires 2 extending one-dimensionally and approximately parallel to one another in Direction B (indicated by arrow B in FIG. 1B) which is approximately perpendicular to Direction A (indicated by arrow A in FIG. 1B) in which the pair of outer electrodes 3*a* and 3*b* faces each other. The outer peripheral surfaces of the thermistor body 1 and the exposed end surfaces 2*a* of the metallic wires 2 from the thermistor body 1 are entirely covered by an electrically insulating resin material 4.

According to one example of this embodiment, three pieces of metallic wire of diameter 0.8 mm, consisting of a copper wire with a circular cross-sectional shape with its surface plated with nickel, are disposed next to one another such that the distance D between each mutually adjacent pair of these metallic wires 2 is 0.1 mm. The surface of each metallic wire 2 may be roughened to a roughness of about $R_a$=0.1–1.0 $\mu$m such that the metallic wires 2 contact the thermistor body 1 more intimately.

Although not shown in detail, the outer electrodes 3*a* and 3*b* are each of a layered structure with a nickel layer formed on the surface of the thermistor body 1 by sputtering and a layer of tin or a tin alloy formed over the nickel layer by electrolytic plating.

Figure 2A:
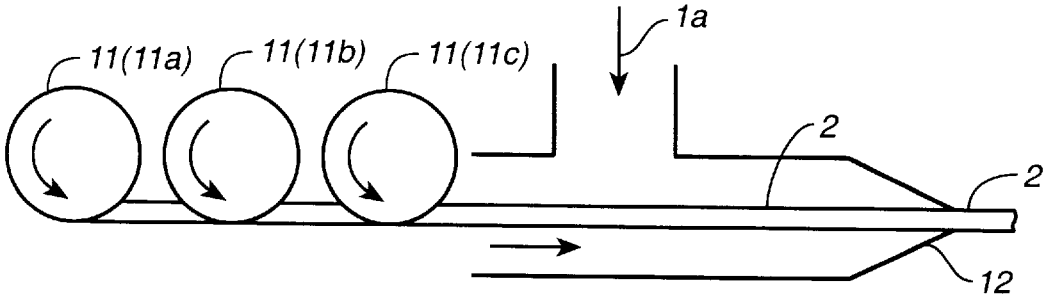
FIGS. 2A, 2B, 2C, 2D, 2E, 2F and 2G are views of the organic thermistor device of FIGS. 1A and 1B at various stages of its production by a method embodying this invention.
Figure 2B:
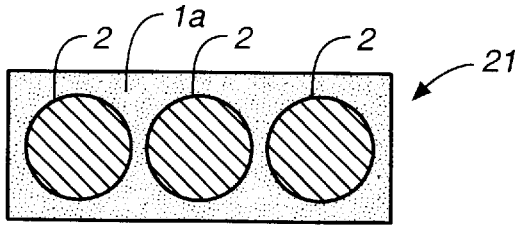

Organic thermistor devices as described above may be produced as follows. Firstly, as shown in FIG. 2A, three reels 11 (or 11*a*, 11*b* and 11*c*) each with a metallic wire wound around it are provided and the three metallic wires 2 pulled out of them are passed through a three-hole dice nipple 12 of a molding machine while an organic thermistor material which has been heated and has become soft is poured in to form by extrusion molding a flat elongated wire-containing member 21 having the metallic wires 2 buried inside an organic thermistor material la as shown in FIG. 2B.

Figure 2C:
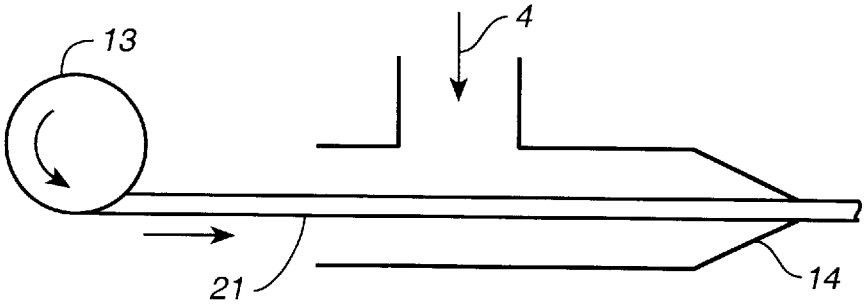
Figure 2D:
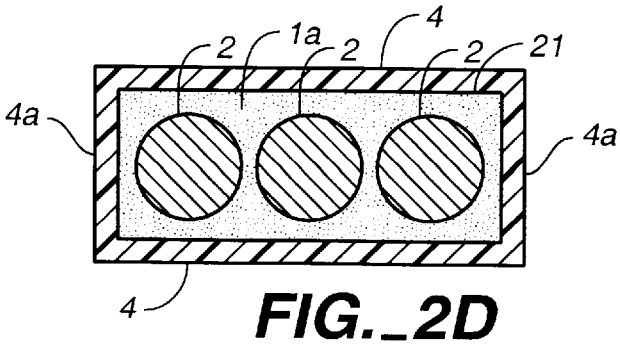

Next, as shown in FIG. 2C, the elongated wire-containing member 21 is pulled out of a reel 13 around which it has been wound and is guided to a single-hole dice nipple 14 of the molding machine while an electrically insulating resin material 4 which has been heated and has become soft is poured in to cover the elongated wire-containing member 21 with an insulating resin layer 4, as shown in FIG. 2D.

Figure 2E:
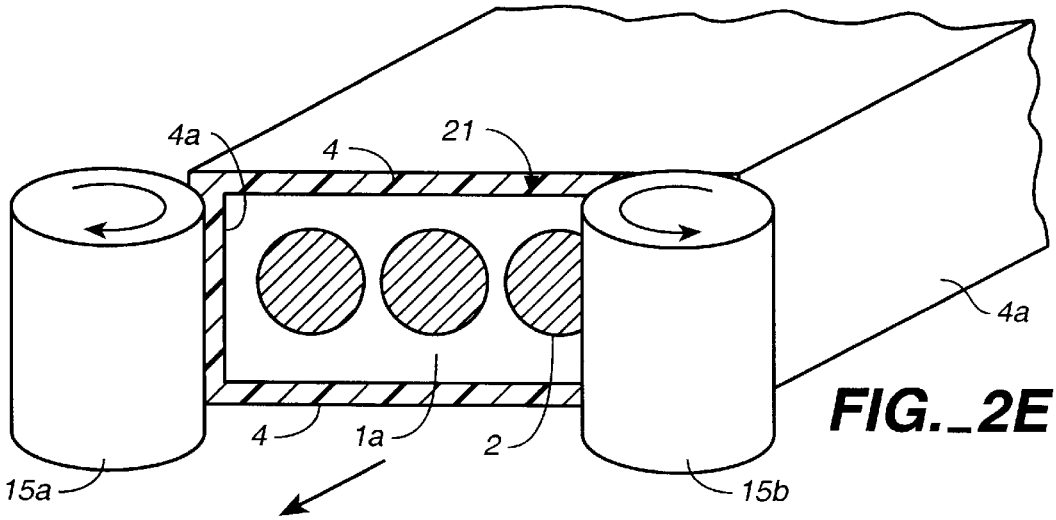
Figure 2F:
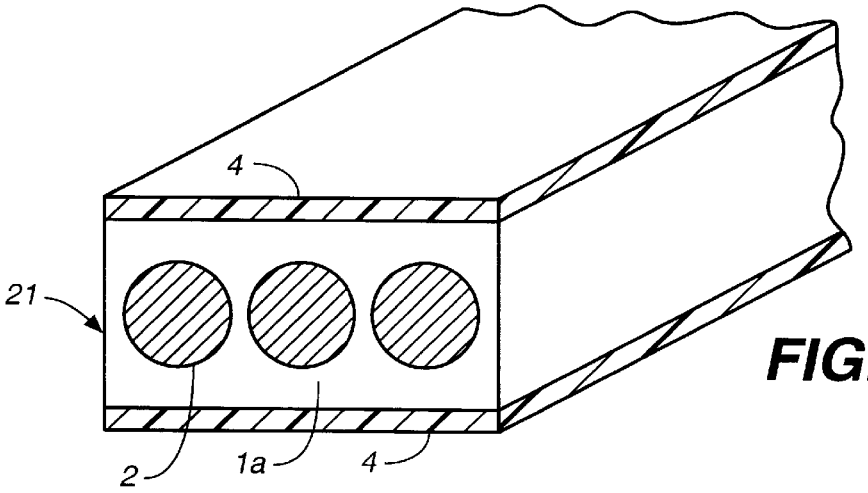

Next, portions of the insulating resin layer 4 (indicated by symbols 4*a*) are removed from a pair of specified longitudinally extending continuous areas on the outer peripheral surface of the organic thermistor material 1 a where outer electrodes are later to be formed. This is done, as shown in FIG. 2E, by disposing a pair of grinders 15*a* and 15*b* each on a different side of the wire-containing member 21 and the wire-containing member 21 is passed between this pair of grinders 15*a* and 15*b* to remove the portions 4*a* of the insulating resin layer 4 on both end surface sides such that the organic thermistor material 1*a* becomes exposed on both sides, as shown in FIG. 2F. Grinders with surface roughness of about #1000–2000 may be used for the purpose. Such grinders can improve the contact between the outer electrodes 3*a* and 3*b* and the organic thermistor material 1*a*, to be discussed below.

Figure 2G:
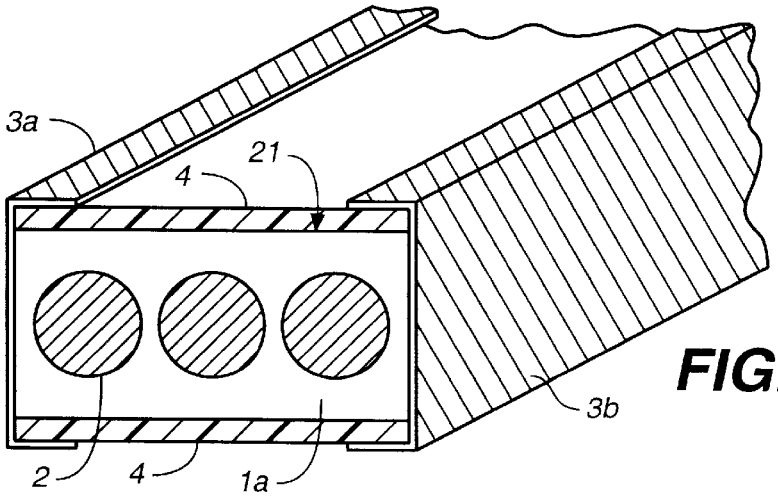

Next nickel layers are formed by sputtering on the surfaces of the organic thermistor material la now exposed on both side surfaces of the wire-containing member 21 with the side portions 4*a* of the insulating resin layer 4 removed by the grinders 15*a* and 15*b*. Thereafter, solder layers or tin layers are formed over the nickel layers by electrolytic plating of a solder or tin in order to improve solderability to form the outer electrodes 3*a* and 3*b*, as shown in FIG. 2G.

The elongated wire-containing member 21, thus provided with the outer electrodes 3*a* and 3*b,* is now cut transversely, or nearly perpendicularly, to the direction of its elongation at specified intervals such as intervals of 1.6 mm, to obtain individual elements. Thereafter, an insulating resin 4 is applied to the newly exposed surfaces of these individually cut elements where the metallic wires 2 are also exposed, and the insulating resin 4 thus applied is hardened by an exposure to an ultraviolet beam to obtain organic thermistor devices as shown in FIG. 1A.

Figure 6:
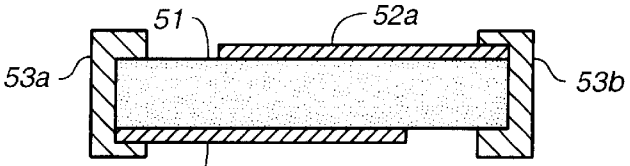
FIG. 6 (PRIOR ART)
FIG. 6 is a sectional view of a prior art organic thermistor device.
Figure 7:
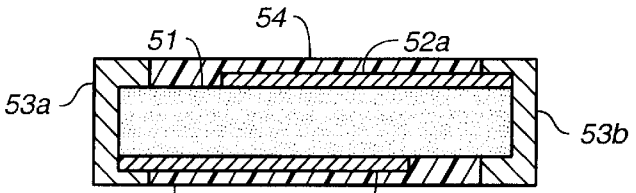
FIG. 7 (PRIOR ART)
FIG. 7 is a sectional view of another prior art organic thermistor device.
Figure 8:
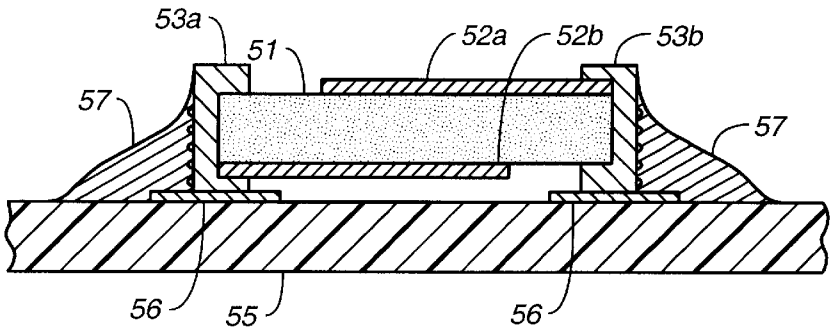
FIG. 8 (PRIOR ART)
FIG. 8 is a sectional view of a prior art organic thermistor device mounted to a circuit board.

With organic thermistor devices thus produced, elements with a low resistance value can be made available since metallic wires are buried inside the thermistor body. While prior art organic thermistor devices as shown in FIG. 7 had to have outer dimensions of about 4.5 mm (length)×3.2 mm (width)×0.3 mm (thickness), as explained above, the dimensions of organic thermistor device according to this invention may be reduced to about 3.2 mm (length)×1.6 mm (width)×1.0–1.6 mm (thickness). Thus, an organic thermistor device of this invention requires a much smaller space for surface-mounting.

Figure 3:
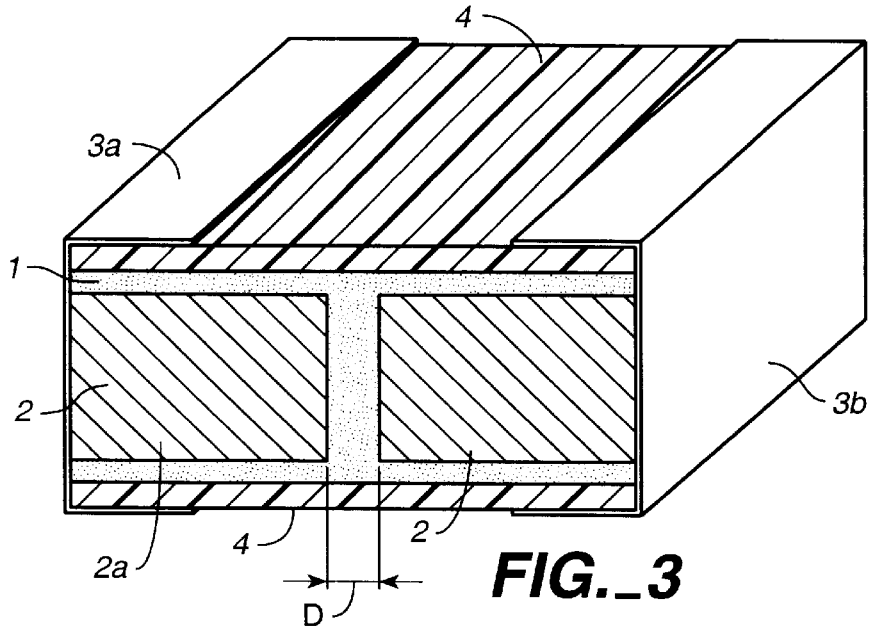
FIG. 3 is a diagonal sectional view of another organic thermistor device embodying this invention.
Figure 4:
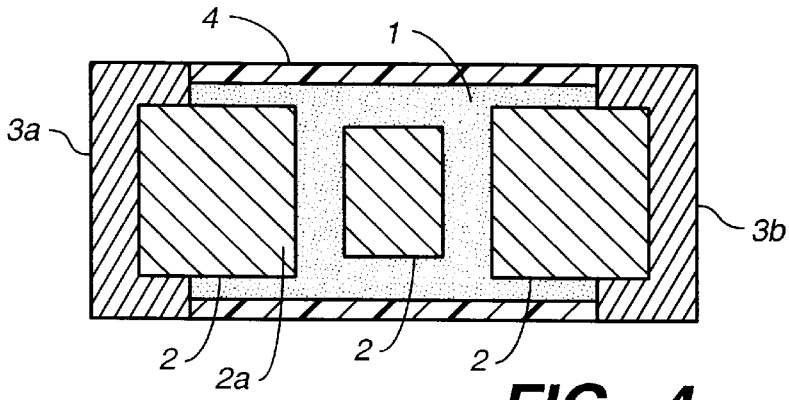
FIG. 4 is a sectional view of still another organic thermistor device embodying this invention.
Figure 5:
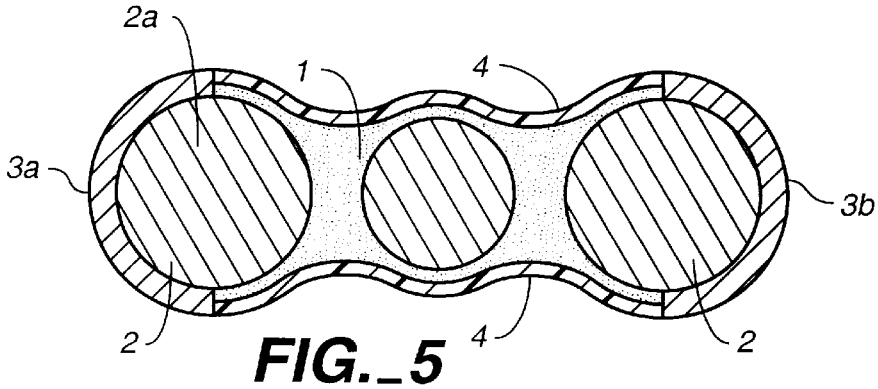
FIG. 5 is a sectional view of still another organic thermistor device embodying this invention.

The invention is not limited by the example described above. Many modifications and variations are possible within the scope of the invention. FIG. 3 shows another organic thermistor device characterized as using two metallic wires 2 each with a rectangular cross-sectional shape and each contacting directly a different one of the outer electrodes 3*a* and 3*b.* Since the resistance value of an organic thermistor device thus structured is determined by the distance D of separation between the two metallic wires 2, an element with an extremely low resistance value can be obtained by reducing this distance D of separation. FIG. 4 shows still another organic thermistor device having three metallic wires 2 each having a rectangular sectional shape. FIG. 5 shows still another organic thermistor device using metallic wires 2 with a circular cross-sectional shape and having the outer electrodes 3*a* and 3*b* shaped such that they each contact directly a portion of outer peripheral surfaces of one of the metallic wires 2.

The material for the metallic wires 2 is not intended to limit the scope of the invention. If wires made of nickel, tin, aluminum, copper or an alloy having any of these as its main component are used, organic thermistor devices with a low resistance value at normal temperatures can be obtained without increasing the material cost excessively. If the wires are of aluminum or an alloy with aluminum as its principal component, the strength of attachment between the metallic wires and the organic thermistor can be increased by plating the surface of the wires with nickel, tin or copper. If the wires are of copper or an alloy with copper as its principal component, the strength of attachment between the metallic wires and the organic thermistor can be increased by plating the surface of the wires with nickel.

It is also to be reminded that the diameter of the metallic wires and the manner of cutting the elongated wire-containing member may be varied to thereby adjust the resistance value of the thermistor body such that products with a series of different resistance values can be obtained.

What is claimed is:

1. An organic thermistor device comprising:

a thermistor body made of an organic thermistor material;

mutually separated and disconnected metallic wires extending one-dimensionally in a longitudinal direction inside and through said thermistor body; and a pair of outer electrodes on end parts of said thermistor body, said outer electrodes facing each other in a direction which is transverse to said longitudinal direction and being electrically insulated from said metallic wires.

2. The organic thermistor device of claim 1 further comprising an electrically insulating layer which covers both exposed surfaces of said thermistor body not covered by said outer electrodes and exposed end surfaces of said metallic wires not covered by said thermistor body.

3. The organic thermistor device of claim 2 wherein said metallic wires are parallel to one another.

4. The organic thermistor device of claim 2 wherein said outer electrodes are on mutually oppositely facing surfaces of said thermistor body.

5. The organic thermistor device of claim 1 wherein said metallic wires are parallel to one another.

6. The organic thermistor device of claim 1 wherein said outer electrodes are on mutually oppositely facing surfaces of said thermistor body.

7. The organic thermistor device of claim 1 wherein said metallic wires are at least in part completely inside said thermistor body.

8. A method of producing organic thermistor devices comprising the steps of:

forming a wire-containing member, which has an external peripheral surface and is elongated in a longitudinal direction, by molding an organic thermistor material by covering metallic wires, said wire-containing member comprising a thermistor body made of said organic thermistor material and said metallic wires which are mutually separated and disconnected and extend longitudinally and one-dimensionally through said thermistor body;

forming a pair of longitudinally elongated outer electrodes on mutually opposite sides of said external peripheral surface of said wire-containing member; and thereafter cutting said wire-containing member transversely to said longitudinal direction at specified positions to divide into individual elements.

9. The method of claim 8 further comprising the step of coating exposed surfaces of said individual elements not covered by said outer electrodes with an electrically insulating material.

10. The method of claim 9 further comprising the step of covering said wire-containing member with an electrically insulating material and removing said insulating material from a pair of longitudinally continuous portions of said external peripheral surface of said wire-containing member, said outer electrodes being formed on said pair of longitudinally continuous portions of said external peripheral surface of said wire-containing member.

11. The method of claim 10 wherein said metallic wires are parallel to one another.

12. The method of claim 9 wherein said metallic wires are parallel to one another.

13. The method of claim 8 further comprising the step of covering said wire-containing member with an electrically insulating material and removing said insulating material from a pair of longitudinally continuous portions of said external peripheral surface of said wire-containing member, said outer electrodes being formed on said pair of longitudinally continuous portions of said external peripheral surface of said wire-containing member.

14. The method of claim 13 wherein said metallic wires are parallel to one another.

15. The method of claim 8 wherein said metallic wires are parallel to one another.

16. The method of claim 5 wherein said metallic wires are placed at least in part completely inside said thermistor body.

* * * * *